US007228776B2

(12) United States Patent
Case

(10) Patent No.: US 7,228,776 B2
(45) Date of Patent: Jun. 12, 2007

(54) PUNCH ASSEMBLY

(76) Inventor: Gerald A. Case, 24812 Hon Avenue, Laguna Hills, CA (US) 92653

( * ) Notice: Subject to any disclaimer, the term of this patent is extended or adjusted under 35 U.S.C. 154(b) by 0 days.

(21) Appl. No.: 10/714,184

(22) Filed: Nov. 13, 2003

(65) Prior Publication Data

US 2005/0105982 A1 May 19, 2005

(51) Int. Cl.
*B26F 1/14* (2006.01)

(52) U.S. Cl. ..... 83/689; 83/697; 408/204; 408/233; 279/8

(58) Field of Classification Search ..... 83/13, 83/636, 684, 689, 697, 698.71, 698.91, 699.31, 83/699.41, 699.61, 30, 954, 916, 919, 54, 83/902, 695; 408/204, 207, 233, 238, 239 R; 279/8; 227/64, 76
See application file for complete search history.

(56) References Cited

U.S. PATENT DOCUMENTS

| | | | | | |
|---|---|---|---|---|---|
| 2,145,725 | A * | 1/1939 | Jamieson | 30/366 |
| RE23,211 | E | 3/1950 | Mohaupt | 102/22 |
| 2,920,913 | A * | 1/1960 | Antila | 83/698.91 |
| 3,311,023 | A * | 3/1967 | Kaiser | 409/232 |
| 3,647,310 | A * | 3/1972 | Morse | 408/239 R |
| 3,656,394 | A * | 4/1972 | McCutcheon | 83/689 |
| 3,683,499 | A * | 8/1972 | Robinson, Jr. | 30/360 |
| 3,759,130 | A * | 9/1973 | Patterson | 83/637 |
| 3,970,407 | A * | 7/1976 | Uffman | 408/204 |
| 3,974,728 | A * | 8/1976 | Herlan | 83/686 |
| 4,167,363 | A * | 9/1979 | Whitesel | 408/201 |
| 4,303,357 | A * | 12/1981 | Makar | 408/204 |
| 4,543,722 | A * | 10/1985 | Adleman et al. | 30/360 |
| 4,653,372 | A * | 3/1987 | Pottorff | 83/689 |
| 4,739,687 | A * | 4/1988 | Wanner et al. | 83/688 |
| 4,753,010 | A * | 6/1988 | Franovich | 30/124 |
| 4,793,063 | A * | 12/1988 | Ducret | 30/360 |
| 4,807,367 | A * | 2/1989 | Loerwald | 30/445 |
| 5,029,392 | A | 7/1991 | Bingham et al. | 30/360 |
| 5,074,722 | A * | 12/1991 | Cochran | 408/204 |
| 5,329,835 | A * | 7/1994 | Timp et al. | 83/686 |
| 5,597,274 | A * | 1/1997 | Behner | 408/204 |
| 5,624,213 | A * | 4/1997 | Anderson | 408/206 |
| 5,639,193 | A * | 6/1997 | Anderson | 408/204 |
| 5,727,436 | A * | 3/1998 | Swedberg et al. | 83/686 |
| 5,746,104 | A * | 5/1998 | Russell et al. | 83/698.71 |
| 5,791,837 | A * | 8/1998 | Johnson | 408/204 |
| 6,109,156 | A * | 8/2000 | Tsuchimoto et al. | 83/660 |
| 6,772,667 | B2 * | 8/2004 | Phlipot | 83/684 |
| 6,857,830 | B2 * | 2/2005 | Holcomb | 408/204 |
| 6,981,327 | B2 * | 1/2006 | Nordlin | 30/360 |
| 2003/0015079 | A1 * | 1/2003 | Talarico | 83/698.91 |
| 2003/0213838 | A1 * | 11/2003 | Wright | 234/109 |
| 2005/0031422 | A1 * | 2/2005 | Tseng | 408/204 |
| 2005/0056133 | A1 * | 3/2005 | Huang | 83/686 |

* cited by examiner

*Primary Examiner*—Monica Carter
*Assistant Examiner*—Michael W. Talbot
(74) *Attorney, Agent, or Firm*—Steins & Associates, P.C.

(57) ABSTRACT

A Punch Assembly and the method of use thereof is disclosed. Also disclosed is. The device is designed to be accepted within the chuck of a powder-actuated tool. The device can create a hole in steel decking when the device is shot into the decking by a powder-actuated tool. The device is defined by a mandrel and a detachable punch attached to it. The outer diameter of the mandrel is greater than the outer diameter of the punch so that when the mandrel prevents the device from passing through the hole created by the punch. The punch has a generally cylindrical shape and a cutting edge forming a pair of tips on opposing sides of the cylinder in order to improve the quality of the hole formed in the decking.

7 Claims, 5 Drawing Sheets

PUNCH ASSEMBLY

BACKGROUND OF THE INVENTION

1. Field of the Invention

This invention relates generally to cutting tools and, more specifically, to a Punch Assembly and Method for the use thereof.

2. Description of Related Art

A conventional method for building commercial building structures is to erect each floor of the building by first creating a steel deck structure. Each floor structure is finished by pouring concrete over the top of the steel deck. In advance of pouring the concrete, inserts must be installed in the steel decking so that cables, piping and ducting can route to locations on that level. Electrical conduit and cabling in these commercial buildings is typically supported on racks or laid in cable trays supported by rod inserts installed at intervals along the bottom surface of a particular floor structure (i.e. the ceiling of the floor below). These rod inserts are put in place by inserting them through holes created in the steel decking. The tradespersons must first cut holes in the appropriate locations in the steel decking and then place rod inserts through the holes (the rod inserts also plug the holes). Once all of the rod inserts are in place, the concrete can be poured over the steel decking.

As one can imagine, the wiring complexity of today's commercial buildings mandates that many of these rod inserts are needed to adequately support the cable tray or pipe that is installed. As such, hundreds and even thousands of holes must be punched around every floor of the building. Historically, these holes have been created by one of two methods: (1) the tradesperson uses a weighted, pointed spike or bar to slam down onto the decking; or (2) using a drill motor and a hole saw.

The problems with the spike method are that is dangerous, it requires extreme effort, and it is not a very precise way of locating the holes in the decking. The problems with the drill and hole saw is that it is time consuming, and requires either a AC power source (which is frequently unavailable at this construction stage), or a ready supply of recharged batteries (due to the large number of holes that typically need to be cut).

What is needed, therefore, is a punch device and method of use that permits the tradespersons to quickly and safely punch insitu holes in steel decking.

SUMMARY OF THE INVENTION

In light of the aforementioned problems associated with the prior devices and methods, it is an object of the present invention to provide a Punch Assembly and method for use thereof. The device should be designed to be accepted within the chuck of a powder-actuated tool. The device should be able to create a hole in steel decking when it is shot into the decking by a powder-actuated tool. The device should have a mandrel and a detachable punch attached to it. The outer diameter of the mandrel should be greater than the outer diameter of the punch so that when the mandrel prevents the device from passing through the hole created by the punch. The punch should have a generally cylindrical shape and a cutting edge forming a pair of tips on opposing sides of the cylinder.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a Punch Assembly and method for use thereof.

Figure 2:
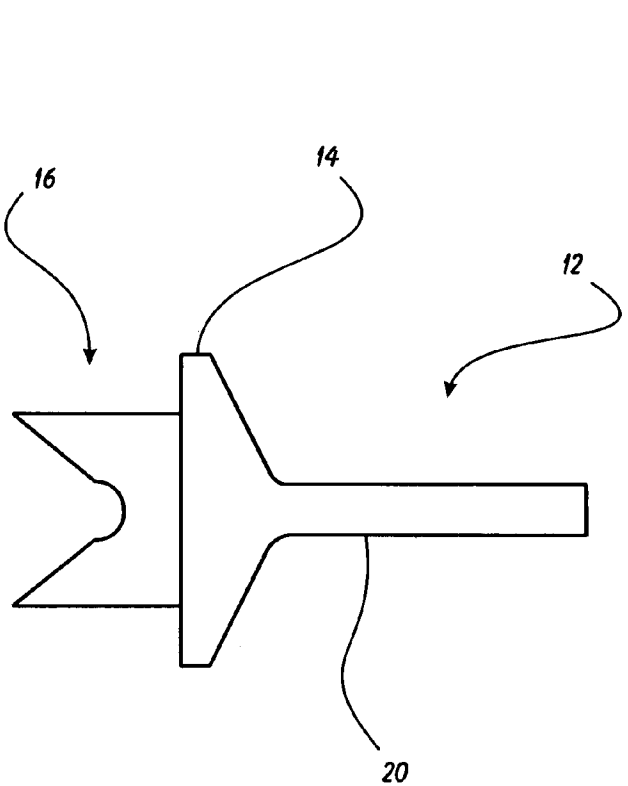
FIG. 2 is a side view of the punch assembly of FIG. 1.
Figure 1:
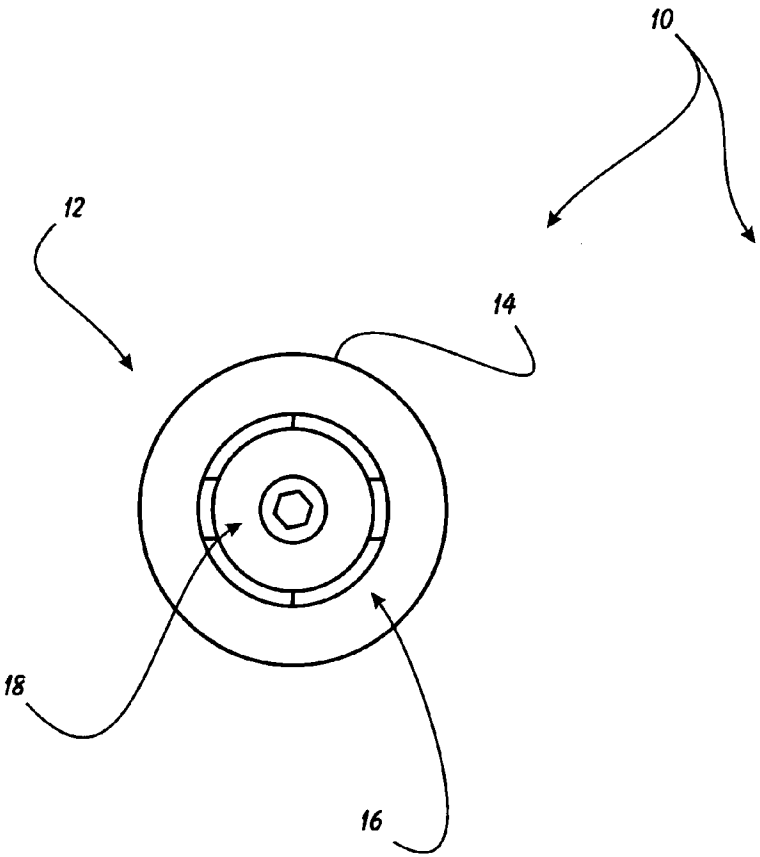
FIG. 1 is an end view of a preferred embodiment of the punch assembly of the present invention.

The present invention can best be understood by initial consideration of FIG. 1. FIG. 1 is an end view of a preferred embodiment of the punch assembly 10 of the present invention. The punch assembly 10 comprises a mandrel 12, a punch 16 and a bolt 18 or other means for securely attaching the punch 16 to the mandrel 12. The mandrel 12 preferably has a head 14 defining a generally circular shape and a diameter that is larger than the punch 16. Turning to FIG. 2, we can continue to examine this device.

Figure 3:
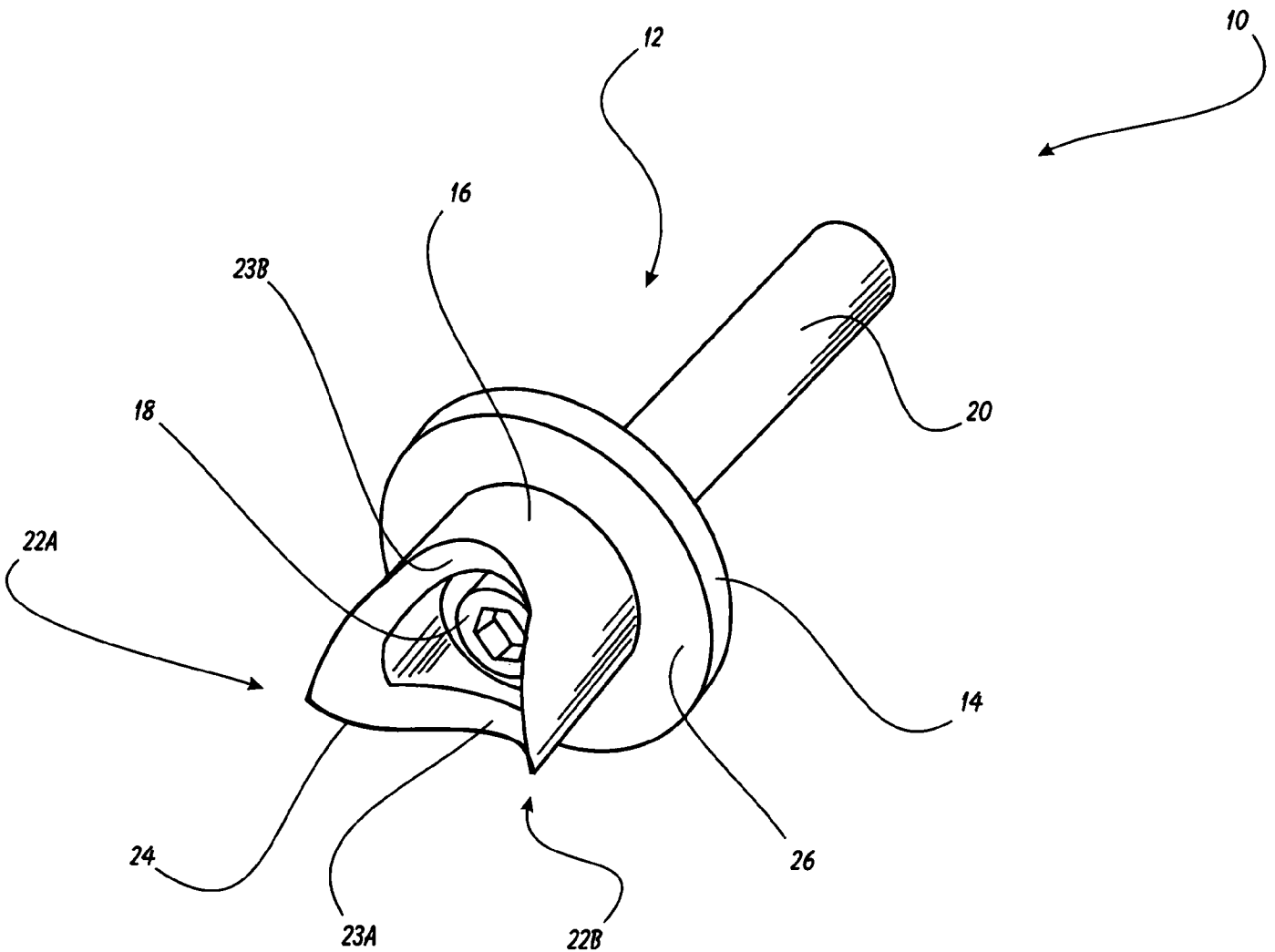
FIG. 3 is a perspective view of the punch assembly of FIGS. 1 and 2.

FIG. 2 is a side view of the punch assembly 10 of FIG. 1. The mandrel 12, in addition to the head 14, has a shaft 20 extending away from the head 14. The punch 16 and mandrel 12 are separate members so that a single mandrel 12 can be coupled with a variety of sizes and types of punches 16, including the ability to replace worn punches 16. FIG. 3 provides additional detail regarding this invention.

FIG. 3 is a perspective view of the punch assembly 10 of FIGS. 1 and 2. When assembled, the assembly 10 has a punch 16 that is defined by a first tip 22A and a second tip 22B. Interspersed between the tips 22 are a first trough 23A and a second trough 23B. The punch 16 further has a cutting edge 24 that runs at the leading edge of the tips 22, and possibly even the troughs 23, depending upon the design of the particular punch 16.

The previously-described tip-and-trough design has been demonstrated to be particularly effective at cutting clean holes through steel decking, as will be described below in connection with other drawing figures.

As shown in FIG. 2 and here In FIG. 3, the mandrel 12 has a generally "T"-shaped longitudinal cross section, with the head 14 forming the top of the "T." The head 1 defines a generally flat face 26 provided as a stable mating surface for the punch 16. As discussed previously, the punch 16 is held to the mandrel 12 with a bolt 18 or other attachment means.

Figure 4:
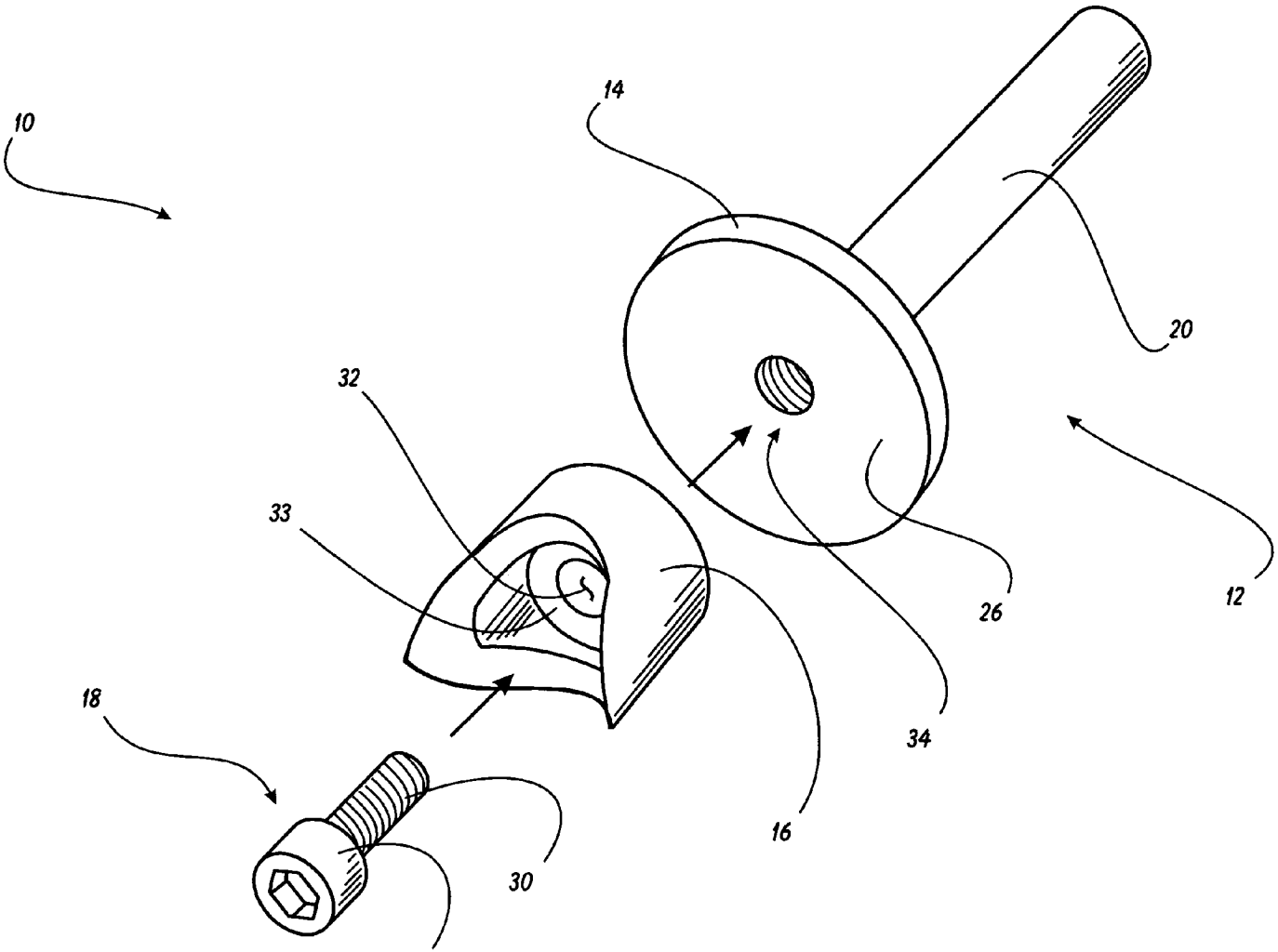
FIG. 4 is an exploded perspective view of the assembly of FIGS. 1–3.

FIG 4 depicts the individual elements of the assembly 10 in additional detail.

FIG. 4 is an exploded perspective view of the assembly 10 of FIGS. 1–3. The bolt 18 comprises a head 28 and a threaded shaft 30 extending therefrom. The head 28 may have the "allen" style wrench socket formed within it, or it may use other conventional head designs to enable the bolt 18 to be tightened and loosened when necessary.

The threaded shaft 30 of the bolt 18 passes through a bore 32 formed in the base 33 of the punch 16. The threaded shaft 30 then engages a threaded bore 34 formed in the center of the mandrel face 26. The bolt 18 is lightened until the punch 16 is securely fastened to the mandrel 12, flush against its face 26.

All of the elements of the assembly 10 are made from hardened steel or other composition to provide superior endurance and strength. Now turning to FIG. 5A and 5B, we can begin to examine how the assembly 10 of the present invention is utilized.

Figure 5A:
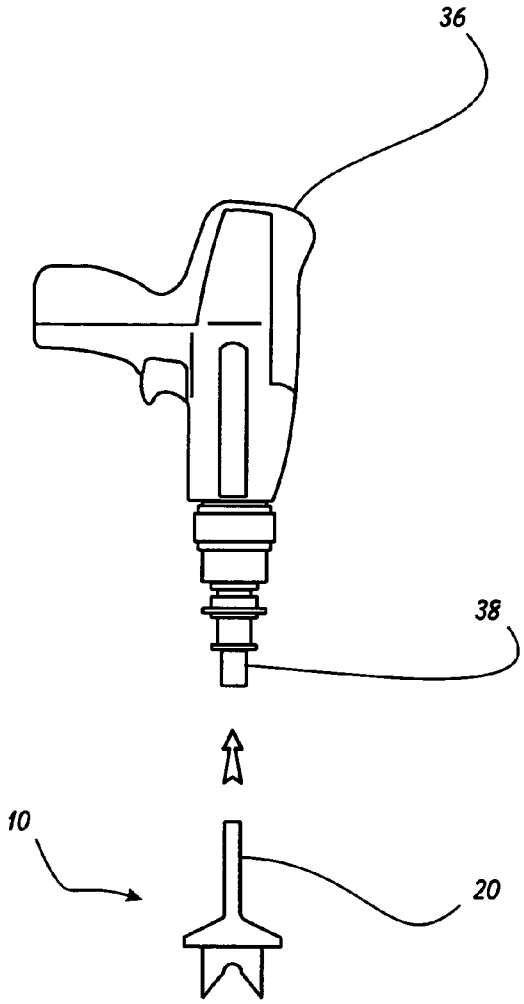
FIGS. 5A and 5B are side views of the assembly of FIGS. 1–4 as it is used with a powder-actuated tool.
Figure 5B:
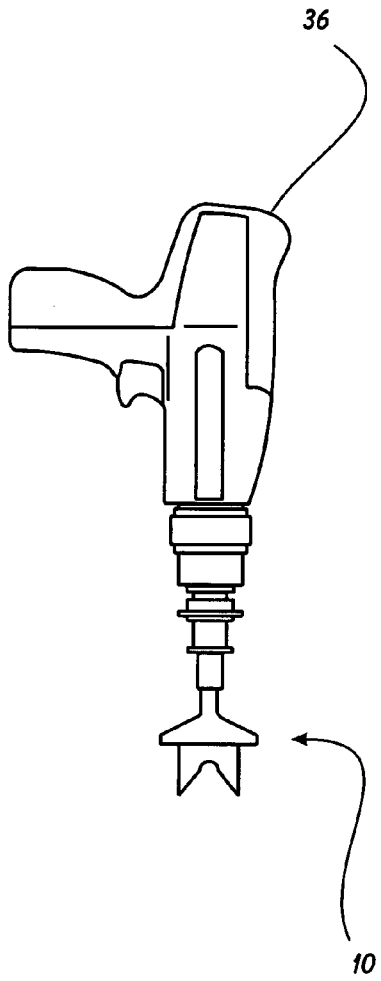

FIGS. 5A and 5B are side views of the assembly 10 of FIGS. 1–4 as it is used with a powder-actuated tool 36. A conventional powder-actuated tool 36 is designed to shoot nails into hardened concrete or other extremely hard materials through the use of an explosive charge acting on the end of the nail to drive the nail into the hard material. These tools 36 are actively used in the construction industry for this purpose.

Figure 6B:
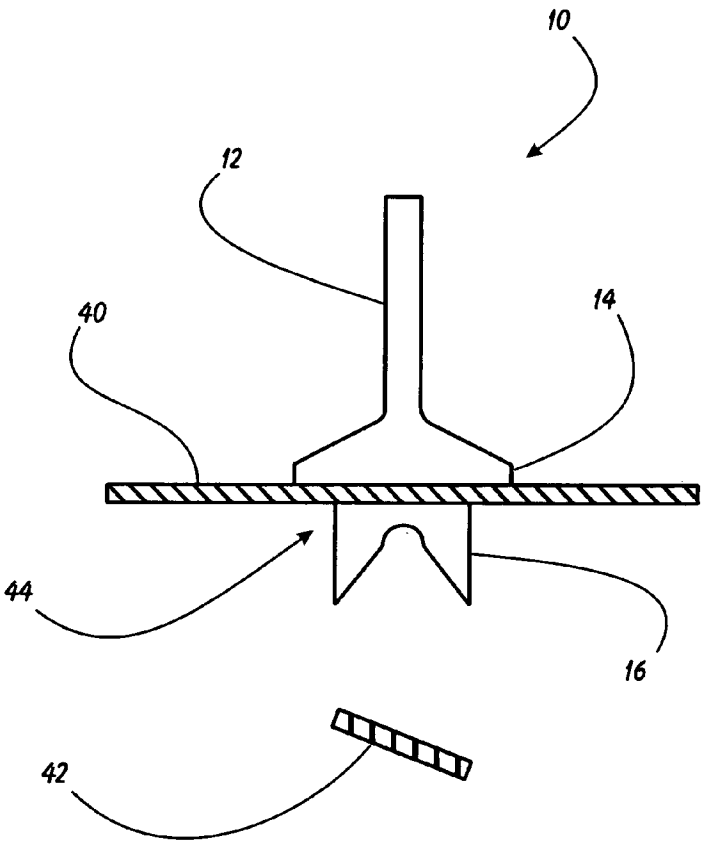
FIGS. 6A and 6B are side views of the assembly of FIGS. 1–5 operating to punch a hole.
Figure 6A:
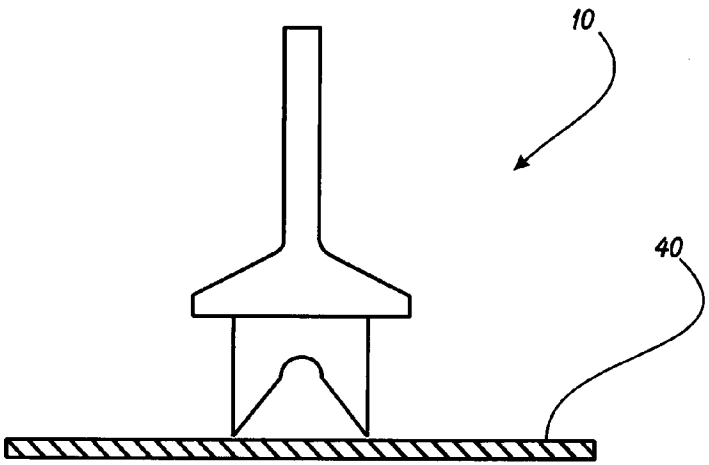

What is unique in the method of the present invention is that the nail normally shot by a powder-activated tool 36 is replaced with the punch assembly 10 described above in connection with previous drawing figures. As shown in these figures, the shaft 20 is configured to cooperate with the standard receiver 38 of the conventional powder-actuated tool 36 so that the shaft 20 can fit therein. Once the assembly 10 is placed into the receiver 38, actuation of the tool 36 will result in the assembly 10 being shot (downwardly in these views) by the explosive charge, rather than a nail being shot by the charge. FIGS. 6A and 6B depict the result of this actuation.

FIGS. 6A and 6B are side views of the assembly 10 of FIGS. 1–5 operating to punch a hole. Although not shown in this figure for the purposes of clarity, it should be understood that the assembly 10 is being driven by a powder-actuated tool, such as the one shown in FIGS. 5A and 5B.

Once the assembly 10 is loaded into the receiver of the tool (see FIGS. 5A and 5B), the tips of the assembly 10 are placed in close proximity to the steel decking 40 in precisely the location that a hole is desired. Next, the trigger is depressed in the tool (see FIGS. 5A and 5B), thereby actuating the powder charge and driving the punch 16 through the decking 40. In the version shown, the punch 16 will create a circular aperture 44 in the decking 40, and will drive a slug 42 (that is the portion of the decking 40 cut out to form the aperture 44) downwardly, presumably into the floor below the decking 40 section. The aperture 44 is formed with clean, burr-free edges in a single, quick action.

The mandrel 12, as discussed above, has a head 14 that defines at least a portion of its cross-section that is larger or outside of the perimeter of the punch 16. Due to this cooperative design choice for the punch 16 and mandrel head 14, the head 14 will be prevented from passing through the aperture 44 formed in the decking 40 when the assembly 10 is shot into the decking 40. In this way, the assembly 10 will remain above the decking 40, and the user will not need a second worker to retrieve the assembly 10 from the floor below.

In use, then, the tradesperson simply moves from hole location to hole location, placing the assembly 10 into the tool receiver, placing the assembly 10 on or near the surface of the decking, and then shooting the punch 16 through the decking to form the hole. This method is much, much quicker and easier than the previously-described methods employing a spike or a punch-and-die.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A punch assembly, comprising:

a mandrel, comprising an elongate shaft having a distal end and a disk-shaped head opposite said distal end, said head defining an outer diameter, and a substantially flat face defined by a threaded bore formed therein, said shaft defining a generally constant diameter over its entire length;

a punch defining a generally cylindrical shape, and having circular cross-section along a longitudinal axis, a base end and a cutting end, said cutting end defining a cutting edge terminating in at least one pointed tip, said base end defining a substantially flat face having an aperture formed therethrough; and attachment means for attaching said punch to said mandrel whereby said base end is adjacent to said face and said attachment means comprising a bolt extending through said aperture and threadedly engaging said threaded bore.

2. The assembly of claim 1, wherein said punch further comprises a generally cylindrical cross-section defining an outer diameter, said head outer diameter being greater than said punch outer diameter.

3. The assembly of claim 2, wherein said punch further defines a pair of opposing arcuate portions on said cutting surface in spaced relation.

4. The assembly of claim 3, wherein said punch comprises a pair of said tips, said tips and said arcuate portions in alternating spaced relation with each other.

5. The assembly of claim 4, wherein said mandrel comprises a elongated shaft having a solid cross-section and defining a distal end and a head end, said head extending from said head end.

6. The assembly of claim 5, wherein said head defines a generally circular cross-section and said threaded bore is located at the center of said cross-section.

7. The assembly of claim 6, wherein said punch defines a cross-section having a generally circular ring shape.

* * * * *